US005461737A

United States Patent [19]

Ikeda et al.

[11] Patent Number: 5,461,737

[45] Date of Patent: Oct. 31, 1995

[54] MATTRESS APPARATUS AND METHOD FOR MANUFACTURING THE SAME

[75] Inventors: Shigeru Ikeda, Kunitachi; Yoshio Oguma, Tokyo, both of Japan

[73] Assignee: France Bed Co., Ltd., Tokyo, Japan

[21] Appl. No.: 132,468

[22] Filed: Oct. 6, 1993

[30] Foreign Application Priority Data

Feb. 16, 1993 [JP] Japan ..... 5-026968
Mar. 12, 1993 [JP] Japan ..... 5-052510

[51] Int. Cl.[6] ..... A47C 27/045

[52] U.S. Cl. ..... 5/475; 5/978; 29/91.1

[58] Field of Search ..... 5/471, 475, 478; 29/91, 91.1, 91.5, 91.6

[56] References Cited

U.S. PATENT DOCUMENTS 3,040,473 6/1962 Wetzler et al. .
3,142,073 7/1964 Stern ..... 5/478
3,950,800 4/1976 Garshfield ..... 5/478 X
4,075,721 2/1978 Autrey .
4,463,466 8/1984 May et al. .
4,476,595 10/1984 Ikeda .
4,788,731 12/1988 Yokoi et al. ..... 5/478

FOREIGN PATENT DOCUMENTS 54-11930 5/1979 Japan .
1281846 7/1972 United Kingdom .

*Primary Examiner*—Michael F. Trettel
*Attorney, Agent, or Firm*—Frishauf, Holtz, Goodman, Langer & Chick

[57] ABSTRACT

A pad is arranged on the upper and lower sides of a spring unit to provide a laminate structure. The laminate structure is covered with an outer cover body comprising top and bottom layers covering the corresponding pads and a side layer covering the laminate structure. A joining member of heat-shrinkable synthetic resin has one end width portion joined to the inner surfaces of the whole marginal edge portions of the top and bottom layers. The other end width portion of the joining member covers the corresponding outer marginal edge portions of the pads. The joining member, upon being heat shrunk, have another end width portion brought into firm engagement with the spring unit so that the pads and outer cover body are firmly held relative to the spring unit.

13 Claims, 8 Drawing Sheets

MATTRESS APPARATUS AND METHOD FOR MANUFACTURING THE SAME

BACKGROUND OF THE INVENTION

1. Field of the Invention

The present invention relates to a mattress apparatus having a laminate structure of a pad-mounted spring unit and an outer cover body covering the laminate structure and a method for manufacturing the same.

2. Description of the Related Art

Generally, the mattress apparatus has a spring unit comprised of rows of many coil springs to provide a laminate structure with pads, such as synthetic cotton and urethane foam, formed thereon. The laminate structure is covered with an outer cover body. The outer cover body comprises top and bottom layers covering the corresponding pads and side layers covering an outer peripheral area of the spring unit.

In the mattress apparatus thus constructed, in order to prevent the pads from being displaced relative to the spring unit, the pads are joined to the spring unit by a greater number of clips. Further, in order to prevent the outer cover body from being displaced relative to the spring unit, flange cloths are joined at one end portion to the inner surfaces of the top and bottom layers and at the other end portion to the marginal edge area of the spring unit by clips as in the case of the pads.

According to the aforementioned arrangement the pads are prevented, by the clips, from being displaced and the outer cover body is prevented, by the flange cloths, from being displaced.

The clipping of the pads to the spring unit requires lots of time, thus leading to lowered production. Further the joining of the flange cloths to the spring unit also takes lots of time on many occasions.

In the case where the mattress apparatus has to be scrapped due to damage caused by the prolonged use of it, it has recently been practiced that those component parts are dismembered for the types of materials to be sorted and for ready disposal. For this reason, it is necessary to scrap the mattress apparatus, while grouping their component parts into metal parts, such as the spring unit, and pads (synthetic cotton, etc., for instance) and outer cover body.

If, however, the pads are joined by many clips to the spring unit as in the aforementioned case, then it is rather difficult to remove the pads from the spring unit and also to remove the outer cover body from the spring unit. Therefore, it takes lots of time to disassemble the component parts for scrapping purpose.

SUMMARY OF THE INVENTION

It is accordingly the object of the present invention to provide a mattress apparatus capable of joining pads and outer cover body to a spring unit without using many clips and doing so without being displaced from the spring unit and capable of readily disassembling the pads and outer cover body and a method for manufacturing the same.

In a preferred embodiment, there is provided a mattress apparatus comprising:

a spring unit having an upper area and lower area;

a pad arranged at least on an upper side of the spring unit to provide a laminate structure;

an outer cover body having a top layer at least on the laminate structure and side layers covering an outer peripheral area of the laminate structure; and joining members made of heat-shrinkable synthetic resin, having a one end width portion joined to an inner surface of the top layer along an outer peripheral area of the pad and the other width end portion and, upon being heat shrunk, enabling the other width end portion of the joining member to firmly engage the spring unit.

According to the present invention as claimed in claim 3, there is provided a method for manufacturing a mattress apparatus by arranging a pad at least on an upper one of upper and lower sides of a spring unit to provide a laminate structure and covering the laminate structure with an outer cover body comprising a top layer covering at least an upper surface of the laminate structure and side layers covering an outer peripheral area of the laminate structure, the method comprising the steps of:

arranging the pad at least on an upper side of the spring unit;

joining, to an inner surface of a marginal edge portion of the top layer, a one end width portion of a joining member made of heat-shrinkable synthetic resin;

arranging the top layer on the pad in a manner to cover an outer peripheral area of the pad with the other end width portion of the joining member;

heat-shrinking the joining member to enable the other end width portion of the joining member to firmly engage an outer peripheral area of the spring unit; and joining, to the outer marginal edge portion of the top layer, the side layers covering the outer peripheral area of the spring unit.

According to the mattress apparatus as claimed in claim 1, when the joining member having its one end portion joined to the top layer of the outer cover body is heat shrunk, then the other end portion of the joining member can be joined to the outer peripheral area of the spring unit so that the joining operation can be readily and rapidly performed. Further, the pad and outer cover body joined by the joining members to the spring unit can be disassembled from the spring unit simply by cutting the joining member of synthetic resin. According to the present method as claimed in claim 3, it is possible to fixedly join the pads and outer cover body to the spring unit rapidly by using the heat-shrinkable joining members.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The embodiments of the present invention will be explained below with reference to the accompanying drawings.

Figure 1:
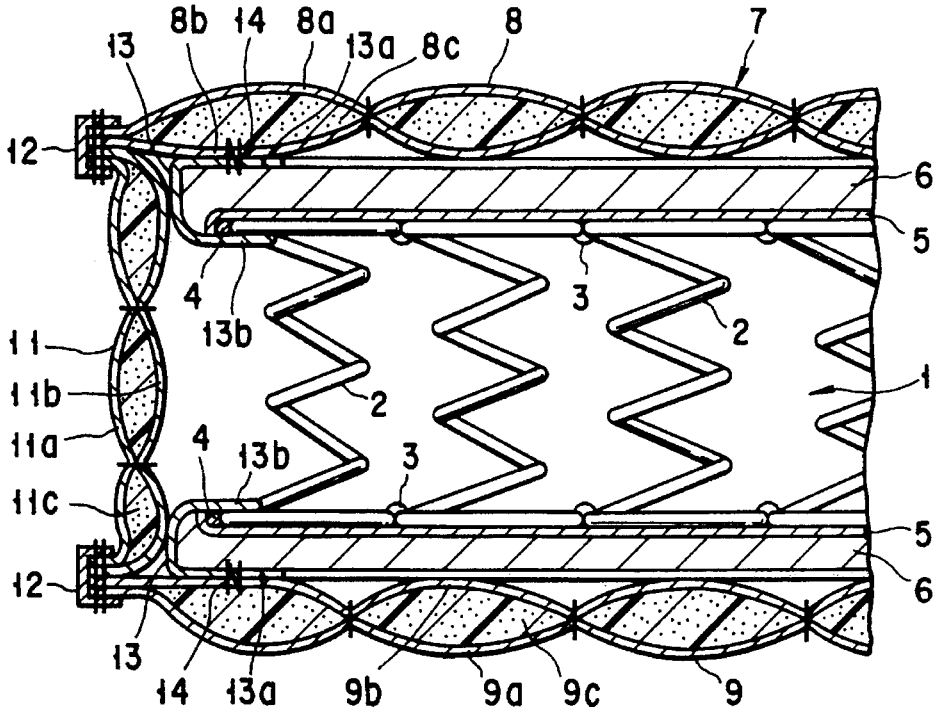
FIG. 1 is a cross-sectional view partly showing a mattress apparatus according to a first embodiment of the present invention.
Figure 2:
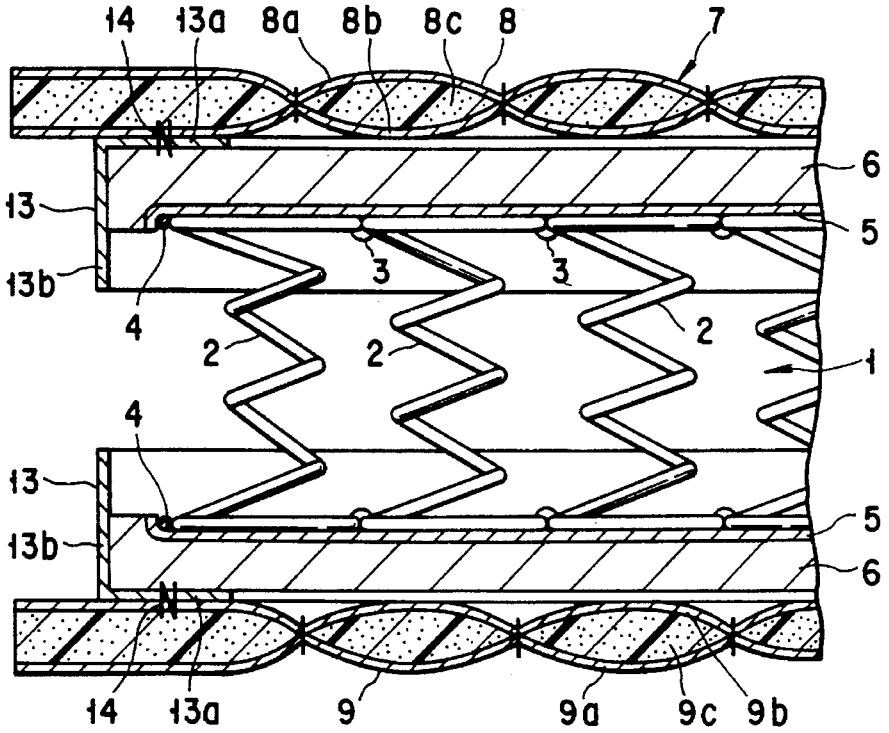
FIG. 2 is a cross-sectional view showing a state before the mounting of side layers of an outer cover body in the mattress apparatus.

FIGS. 1 to 3 show a first embodiment of the present invention. A mattress apparatus as shown in FIG. 1 has a spring unit 1. The spring unit 1 comprises row arrays of many coil springs 2 and herical wires 3 each coupling the upper and lower ends of each coil spring 2 to the corresponding upper and lower ends of the adjacent coil spring 2. Frame wires 4 are connected by clips, not shown, to the marginal edges of the upper and lower sides of the spring unit 1.

A large rectangular pad 6 is arranged, via a sheet-like protection member such as a felt, over the upper and lower sides of the spring unit 1 to provide a laminating structure and is somewhat larger than the upper and lower areas of the spring unit 1. As the pad 6, use is made of one obtained by compression-forming, for example, synthetic cotton to a layer of a predetermined thickness.

The resultant laminate structure, that is, a structure comprising the spring unit 1 and pad 6 on the spring unit, is covered with an outer cover body 7. The outer cover body 7 comprises top and bottom layers 8 and 9 arranged over the upper and lower areas of the spring unit 1 and side layer 11 covering the outer peripheral area of the spring unit. The top and bottom layers 8 and 9 and side layer 11 are comprised of a quilted structure obtained by arranging sheet-like urethane foams 8*c*, 9*c* and 11*c* between surface cloths 8*a*, 9*a* and 11*a* and underlying cloths 8*b*, 9*b* and 11*b*, respectively, and quilting a resultant structure. The upper and lower end portions of the side layer 11 are stitched to the edge portions of the top and bottom layers 8 and 9 as one unit such that the upper and lower end portions of the side layer 11 and edge portions of the top and bottom layers 8 and 9 are covered with corresponding tapes 12.

First joining members 13 are provided, in a loop-like fashion, around the whole peripheral side of the underlying cloths 8*b* and 9*b* of the top and bottom layers 8 and 9 and formed of a relatively soft heat-shrinkable synthetic resin tape or heat-shrinkable synthetic resin fiber-braided cloth. The first joining members 13 are bent in the width direction so as to have an L-shaped cross-section, and have their one end-side portions joined to the underlying cloths 8*b* and 9*b* by a means, such as a bonding agent and stitching (by a string 14 in the present embodiment).

As the heat-shrinkable resin of which the first joining member 13 is made, use is made of vinyl chloride resin, EPT, PETP, crosslinking polyethylene, silicone rubber, et al. The first joining member is so heat formed as to be returned back to its original shape, a phenomenon which is utilized according to the present invention.

In the state in which the top and bottom layers 8 and 9 are arranged one above another on the pads 6 and 6, the one-end 13*a* side of the first joining member 13 is joined to the pad 13 contiguous to the bottom layer 9, that is, on that side far from the spring unit 1, and the other end 13*b* side of the first joining member 13 covers the outer side surface of the pad 6. In this state, if the first joining member 13 is shrunk by the application of heat, then the other end 13*b* side of the first joining member 13 covering the outer peripheral area of the pad 6 is bent inwardly of the loop and hence engages the outer edge portion of the spring unit 1 as shown in FIG. 1.

It is to be noted that, after the first joining member 13 is heat shrunk, the side layer 11 have their upper and lower end portions stitched to the edge portions of the top and bottom layers 8 and 9 with their respective tapes 12 covered over the stitched end side as shown in FIG. 1.

The manufacturing steps of the mattress apparatus so constructed will be explained below with respect to FIGS. 3A to 3D.

Figure 3A:
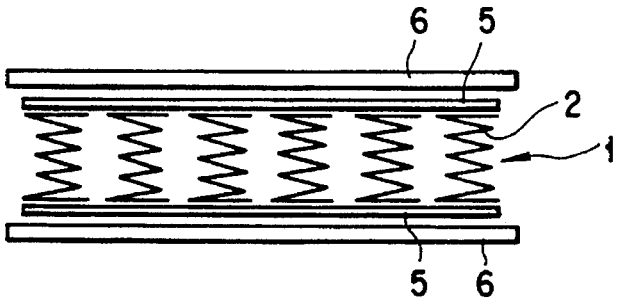
FIG. 3A is an explanative view showing a manufacturing step of the mattress apparatus.
Figure 3B:
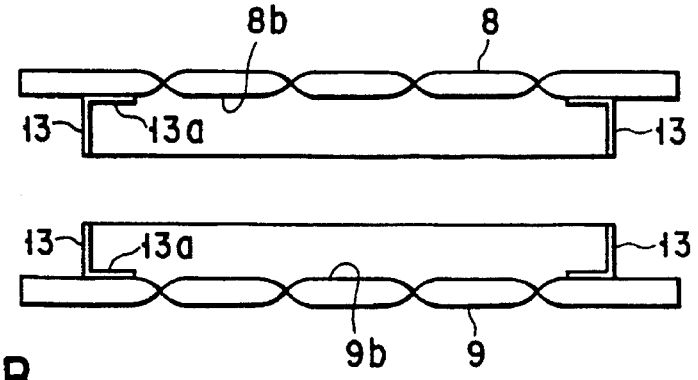
FIG. 3B is an explanative view showing another manufacturing step of the mattress apparatus.

FIG. 3A shows a first step at which the pads 6, 6 are arranged one over the upper area and one over the lower area of the spring unit 1 with each protection member 5 placed therebetween. FIG. 3B shows a second step effected in a way parallel to the first step timewise. At the second step, the one end 13*a* side portion of the first joining member 13 as viewed in the width direction is attached, by a bonding agent or stitching, to the whole inner marginal edge portions of the underlying cloths 8*b* and 9*b* of the top and bottom layers 8 and 9.

Figure 3C:
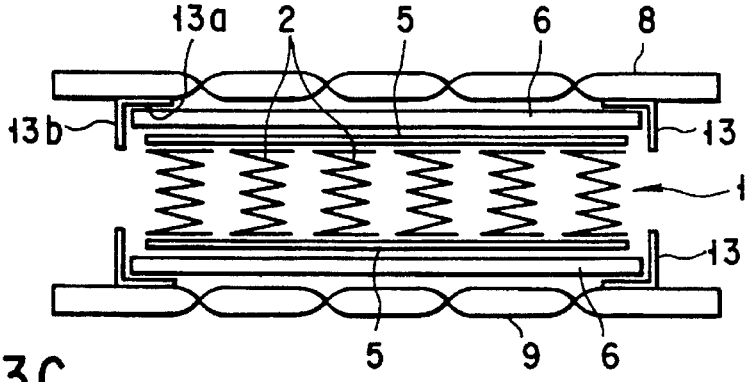
FIG. 3C is an explanative view showing another manufacturing step of the mattress apparatus.

At the third step as shown in FIG. 3C, the top and bottom layers 8 and 9 are stacked over the corresponding pads 6 and 6 with the one end 13*a* sides of the first joining members 13 fixed thereto and the pads 6, 6 stacked over the upper and lower areas of the spring unit 1.

Figure 3D:
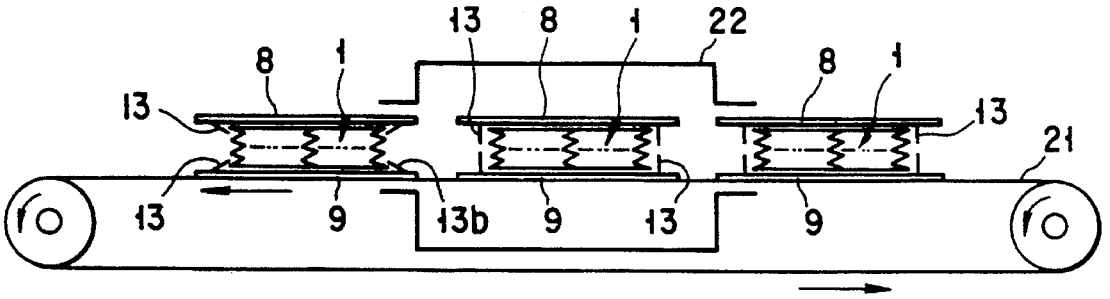
FIG. 3D is an explanative view showing another manufacturing step of the mattress apparatus.

The resultant spring unit 1 with the top and bottom layers 8 and 9 thus stacked at the third step is loaded by a conveyor 21 into a hot air heating furnace 22 at the fourth step shown in FIG. 3D where the spring unit is heated by the hot air to 50° C. to 130° C.

By so doing, the respective first joining members 13 mounted on the inner side of the top and bottom layers 8 and 9 are heat shrunk and the other end 13*b* sides of the respective first joining members 13, 13 as viewed in the width direction engage the upper and lower end edge portions of the spring unit 1 as shown in FIG. 1. By so doing, the top and bottom layers 8 and 9 are fixed to the spring unit 1 with the one end 13*a* sides of the first joining member 13 and 13 joined thereto and the respective pads 6, 6 one between the top layer 8 and the upper area of the spring unit 1 and one between the bottom layer 9 and the lower area of the spring unit 1 are fixed to the spring unit 1, thus offering an integral laminate structure comprising the spring unit 1, pads 6, 6 and top and bottom layers 8 and 9.

At the fifth step, the outer peripheral area of the spring unit 1 of the laminate structure unloaded out of the heating furnace 22 is covered with the side layer 11 as shown in FIG. 1 and the upper and lower end portions of the side layers are stitched to the outer edges of the top and bottom layers 8 and 9 with the tapes 12 provided there, thereby manufacturing the mattress apparatus.

According to the mattress apparatus thus manufactured, the pads 6, 6 and top and bottom layers 8, 9 arranged over the spring unit 1 are joined to the spring unit 1 with the first joining members 13, 13 heat-shrunk on the top and bottom layers 8 and 9 and the other end 13*b* sides of the first joining members 13, 13 set in engagement with the upper and lower edge portions of the spring unit.

That is, the pads 6, 6 and top and bottom layers 8, 9 arranged one over another over the spring unit 1 can be fixedly joined to the spring unit 1 simply by heat-shrinking the first joining member 13. For this reason, the joining of the pads 6, 6 and top and bottom layers 8, 9 can automatically be made more readily and rapidly than the conventional operation using many clips. It is thus possible to make such joining operation without relying upon any hand operation.

The mattress apparatus thus constructed can be scrapped in such a way as set out below.

In the case where the pads 6, 6 and outer cover body 7 are to be separated from the spring unit 1, the tapes 12 are peeled off the top and bottom layers 8, 9 and the side layer 11 are removed from the rest of the apparatus body. Then cuts are made by a cutter or any proper means in the other end 13*b* side of the first joining members 13, in the width direction, engaging the spring unit 1. Then the other end 13*b* portions of the first joining members are torn from the cuts there in the peripheral direction of the spring unit 1.

By so doing, the pads 6, 6 and top and bottom layers 8, 9 are disengaged from the other end 13*b* side of 10 the first joining member 13 and the pads 6, 6 and top and bottom layers 8, 9 can be separated off the spring unit 1. Stated in another word, at a time of scrapping, the pads 6, 6 and outer cover body 7 can be separated from the spring unit 1 merely by a relatively simple operation, that is, simply by tearing away the first joining members 13 formed of the tape-like synthetic resin member.

It will be appreciated that the other end side portions of the first joining members 13, 13 can be positively joined to the upper and lower edge portions of the spring unit 1 by bending the other end side portions of the first joining members 13, 13 prior to the heat shrinking of the first joining members 13.

The first embodiment of the present invention can be applied to the so-called bottom type mattress apparatus, that is, the mattress apparatus with a pad 6 attached to the upper side only of the spring unit 1.

Figure 4:
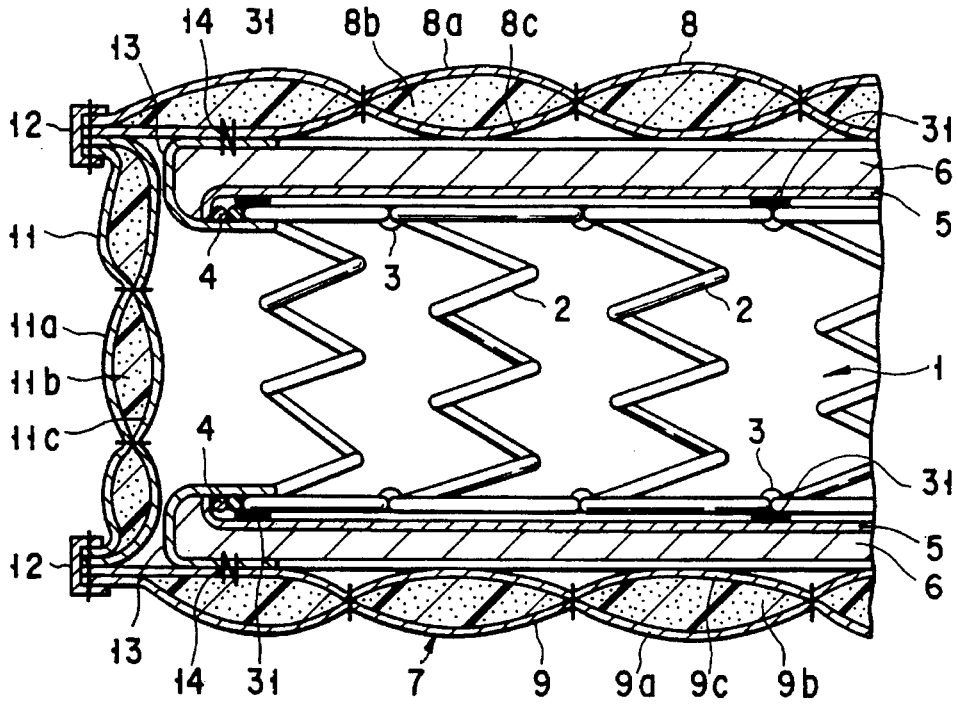
FIG. 4 is a cross-sectional view partly showing a mattress apparatus according to a second embodiment of the present invention.

FIG. 4 shows a second embodiment of the present invention. In the second embodiment, pads 6, 6 are partially temporarily joined, by a thermosetting bonding agent 31, to the upper and lower areas of a spring unit 1 with a protection member 5 set therebetween. The protection member 5 is initially bonded to the pads 6, 6 to provide an integral structure in this case. As the thermosetting agent 31 use is made of an agent which is cured at a temperature (for example, about to 50° ) lower than a temperature at which a first joining member 13 is heat shrunk.

If, in this way, the pads 6, 6 are bonded by the thermosetting bonding agent 31 to the spring unit 1, the thermosetting bonding agent 31 is cured prior to the heat shrinking of the first joining member 13, so that the pads 6, 6 are fixed to the spring unit 1. Even in the case where the heat shrinking of the first joining member 13 is not progressed uniformly in the circumferential direction of the spring unit 1, the pads 6, 6 can be prevented from being displaced on the spring unit 1. Further since the pads 6, 6 are partly bonded by the thermosetting bonding agent, it is possible to readily separate the pads 6, 6 from the spring unit 1 when the bed apparatus is disassembled.

In this connection it is to be noted that an ordinary bonding agent, being cured without being heated, may be used in place of the thermosetting resin upon the bonding of the pads 6, 6 to the spring unit 1.

Figure 5:
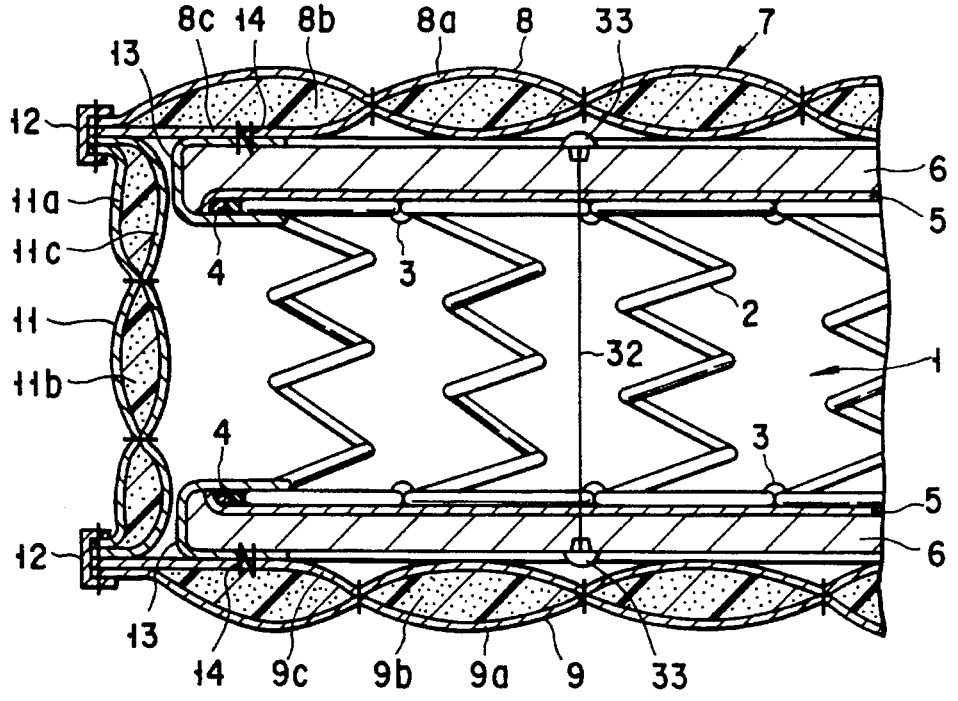
FIG. 5 is a cross-sectional view partly showing a mattress apparatus according to a third embodiment of the present invention.

FIG. 5 shows a third embodiment of the present embodiment. In the third embodiment, a string-like line 32 is passed through pads 6, 6 arranged on the upper and lower areas of a spring unit 1 and a button 33 is attached to each end of the string-like line extending out of the pad 6. By so doing the pads 6, 6 are temporarily joined to the spring unit 1.

According to the arrangement of the third embodiment, the pads 6, 6 are initially fixed to the spring unit 1 and it is easy to handle the following laminate structure before the heat-shrinking of the first joining members 13, 13, that is, a structure comprising the spring unit 1, protection member 5, pads 6, 6 and top and bottom layers 8 and 9.

FIGS. 6 to 9 show a fourth embodiment of the present invention. In the fourth embodiment, the same reference numerals are employed to designate parts or elements corresponding to those shown in the first embodiment. Any further explanation is, therefore, omitted for brevity's sake.

Figure 6:
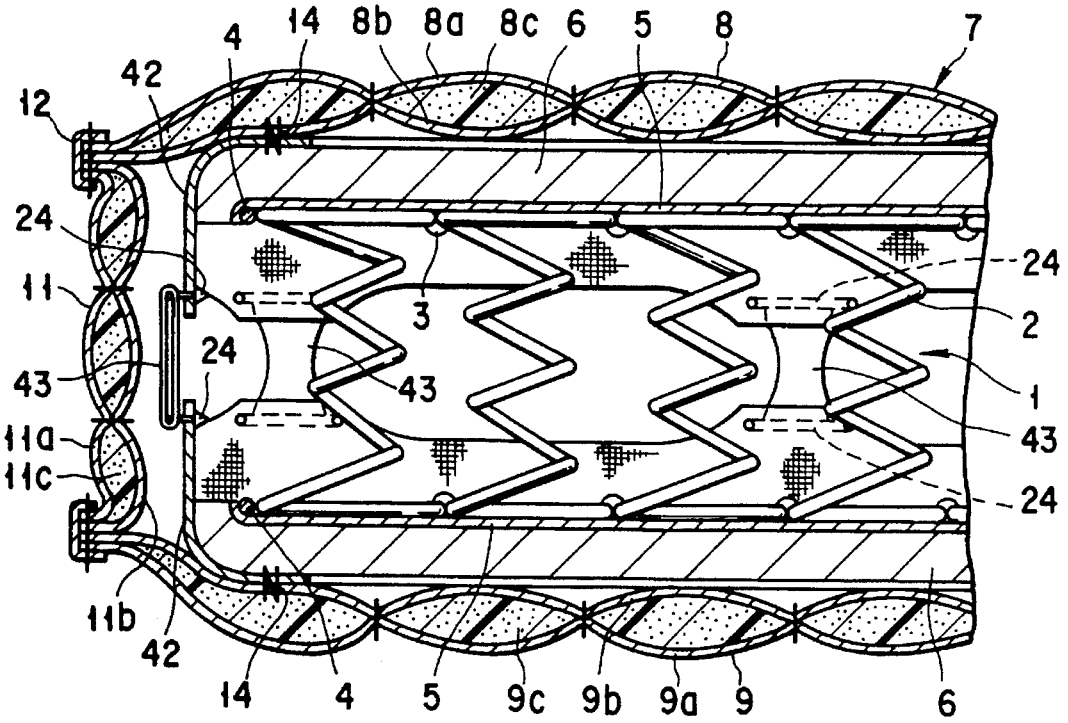
FIG. 6 is a cross-sectional view partly showing a mattress apparatus according to a fourth embodiment of the present invention.
Figure 7:
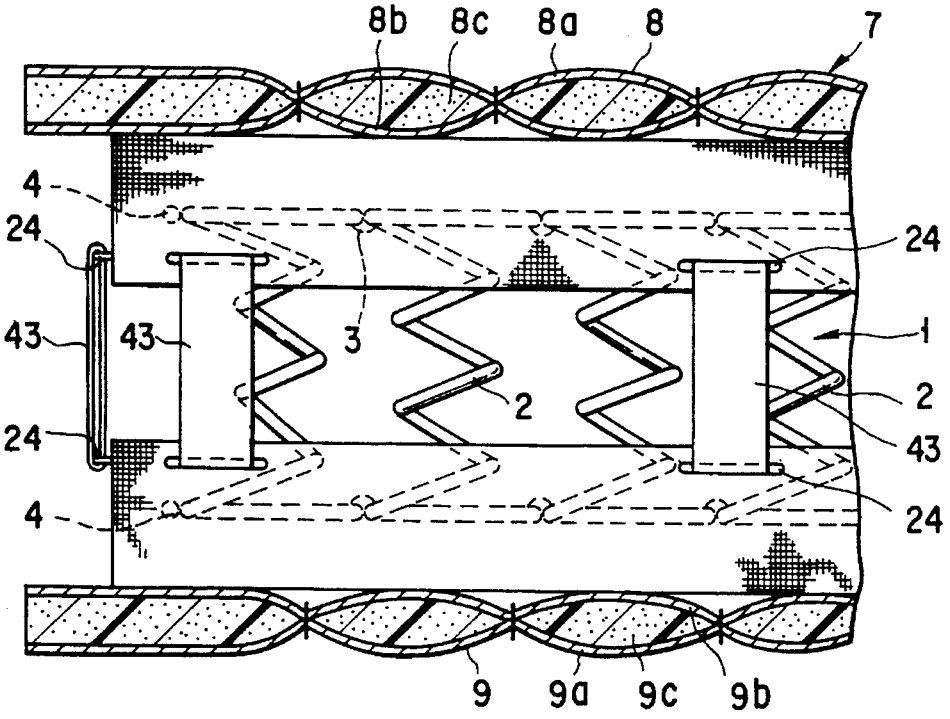
FIG. 7 is a cross-sectional view showing a state before the mounting of side layers of an outer cover body in the mattress apparatus.

In the fourth embodiment, as shown in FIGS. 6 and 7, the one end side portions of a pair of flange cloths 42, 42 as viewed in the width direction are stitched by strings 14 to underlying cloths 8*b*, 9*b* of top and bottom layers 8, 9 along the whole circumference of the flange cloths 42, 42 and the other end side portions of the flange cloths 8*b*, 9*b* cover corresponding pads 6, 6. Second joining members 43 are attached by joining bars 24 to the mutually facing other end sides of the pair of flange cloths 42, 42, upper and lower, at a predetermined interval in the circumferential direction of the flange cloths 42, 42 such that these second joining members 43 are situated at a middle height of the spring unit 1. The second joining members 43 are formed of a relatively soft heat-shrinkable synthetic resin tape or heat-shrinkable synthetic fiber-braided cloth and used as loop-like members.

Figure 8:
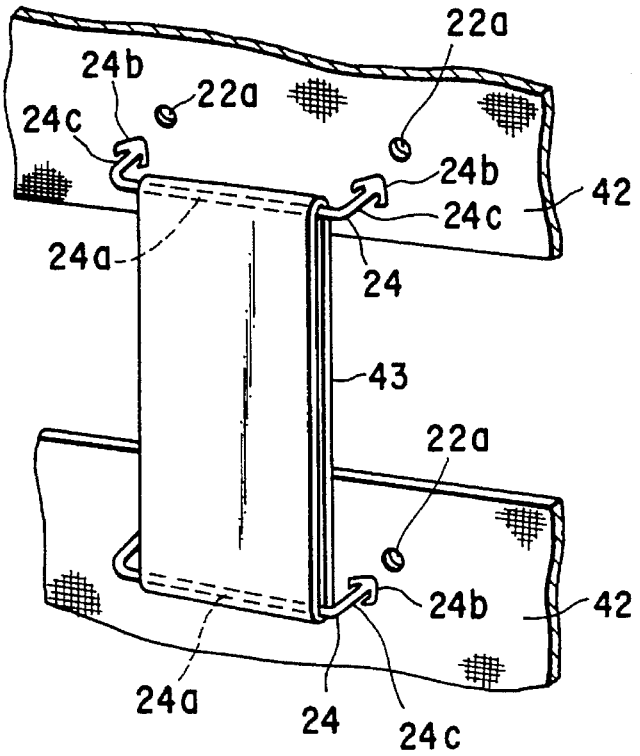
FIG. 8 is a perspective view showing a joining member and joining bars in the apparatus of FIG. 7.

As shown in FIG. 8 a joining bar 24 has an intermediate area 24*a* somewhat longer than the width of the second joining member 43 and end arms 24*c* formed as wedge-like slip-off arms 24*b* one at each L-bent end of the joining bar 24 with the intermediate area 24*a* provided between the L-bent ends of the joining member 43. The intermediate area 24*a* and end arms 24*c* of the joining bar 24 are formed of a somewhat rigid material, such as synthetic resin or metal, and provide a single-unit structure.

A pair of engaging holes 22*a* are provided in the other end side portion of each of the upper and lower flanges 42, 42 at a predetermined interval in the circumferential direction of the flanges. The second joining member 43 is mounted between the upper and lower flange cloths 42 in a stretched fashion by inserting the intermediate areas 24*a* of the paired joining bars 24 into the loop of the second joining member 43 and forcing the slip-off preventing sections 24*b* into corresponding engaging holes 22*a* in the other end side portions of the upper and lower flange cloths 42.

The second joining members 43, being heated, have their loops heat-shrunk in an up/down direction of the spring unit 1 and a tension force is imparted to the other end sides of the flange cloths 42 by the heat shrinkage. Since the pads 6, 6 have heir edge portions compressed by the flange cloths 42, 42 in a packed state, the spring unit 1 is held in place.

At the same time, the top and bottom layers 8 and 9 are held in place by the flange cloths 42, 42 relative to the spring unit 1.

Figure 9A:
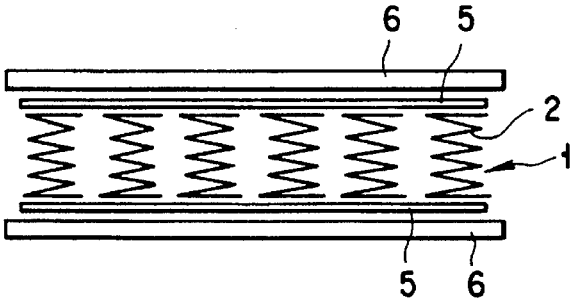
FIG. 9A is an explanative view showing a manufacturing step of the mattress apparatus.
Figure 9B:
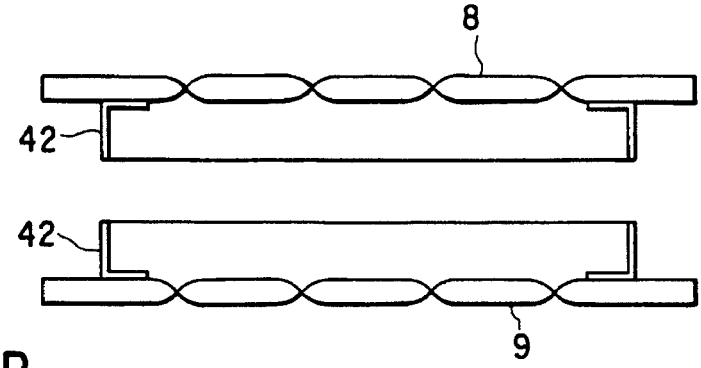
FIG. 9B is an explanative view showing another manufacturing step of the mattress apparatus.

FIGS. 9A to 9D show the manufacturing steps of the mattress apparatus thus arranged. FIG. 9A shows a first step at which pads 6, 6 are arranged on the upper and lower areas of the spring unit 1 with protection members 5 and 5, each, provided between the pad and the protection member 5. At a second step as shown in FIG. 9B, the one end side portions of the flange cloths 42 are stitched to the inner surface of the marginal edge portions of the top and bottom layers 8 and 9 of the outer cover body. In this connection it is to be noted that the step 2 can be done in a parallel relation to the step 1.

Figure 9C:
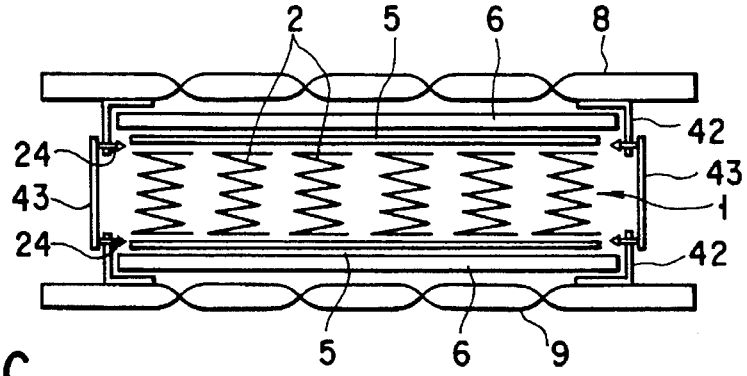
FIG. 9C is an explanative view showing another manufacturing step of the mattress apparatus.

At a third step as shown in FIG. 9C, the top and bottom layers 8 and 9 with the one end side edge portions of the flange cloths 42, 42 stitched thereto are set in contact with the pads 6 and 6 arranged over the upper and lower areas of the spring unit 1 and the second joining members 43 are joined, by joining bars 24, 24, to the other end side portions of the flange cloths 42, 42. That is, the second joining members 43 are arranged at a predetermined interval along the marginal edge portion of the upper and lower flange cloths 42, 42 such that the upper and lower flange cloths are pulled at their other end side portions. By so doing, the other end side portions of the flange cloths 42, 42 cover the outer peripheral area of the pads 6 and 6 with the one end side portions of the flange cloths 42 already stitched to the inner marginal end edge portions of the top and bottom layers. FIG. 9C shows a state in which the second joining members 43 are each mounted between the ends of the upper and lower flange cloths 42, 42.

Figure 9D:
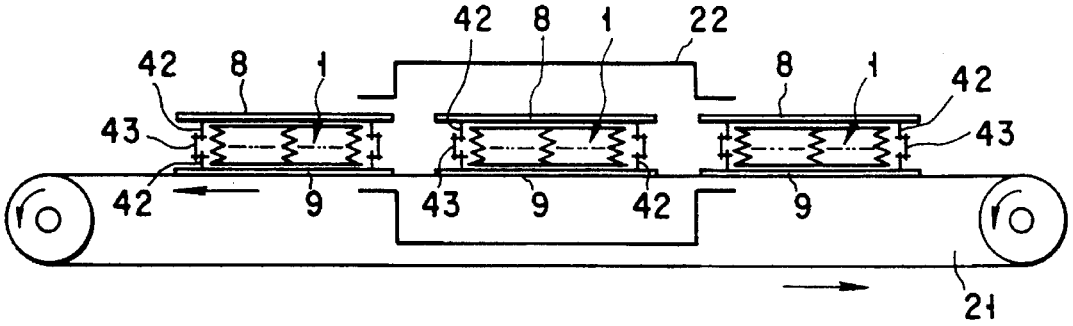
FIG. 9D is an explanative view showing another manufacturing step of the mattress apparatus.

When the pads 6, 6 and top and bottom layers 8, 9 are arranged over the upper and lower areas of the spring unit 1 with the upper and lower flange cloths 42, 42 joined by the second joining members 23, then at a fourth step as shown in FIG. 9D a resultant laminate structure comprising the spring unit 1, pads 6, 6 and top and bottom layers 8 and 9 is loaded by a conveyor 21 into a hot air heating furnace 22.

The hot air in the heating furnace 22 is prevalent at 50° to 130° C., a temperature at which the second joining members 43 are heat shrunk. At that temperature, when the second joining member 43 together with the aforementioned laminate structure is heated and hence the spring unit 1 is heat shrunk at its level of height, the upper and lower flange cloths 42, 42 are pulled at their other end sides and hence a tension force is 10 imparted to the other end side of the flange cloth 42. When the flange cloth 42 is so pulled at their other end side, the pads 6, 6 covered at their marginal edge side with the flange cloths 42 are held in firm contact with the spring unit 1 and hence the top and bottom layers 8 and 9 are fixed to the spring unit 1 with the one end sides of the flange cloths 42, 42 joined to the top and bottom layers.

At a fifth step, the outer peripheral area of the spring unit 1 of the laminate structure unloaded out of the heating furnace 22 is covered with side layer 11 and the upper and lower edge portions of the side layer 11 are stitched to the outer edge portions of the top and bottom layers 8 and 9 with the tape 12 attached to the ends of the top, bottom and side layers to provide the mattress apparatus as shown in FIG. 6.

According to the mattress apparatus thus arranged, the pads 6, 6 and top and bottom layers 8 and 9 mounted over the spring unit 1 are fixedly joined to the spring unit 1 simply by heat shrinking the second joining members 43 and hence the fixedly joining of the pads 6, 6 and top and bottom layers 8 and 9 to the spring unit 1 can be effected readily and rapidly in an automatic fashion, that is, without any hand operation.

when the spring unit 1, pads 6, 6 and outer cover body 7 are to be separated from the mattress apparatus for scrapping purpose, the tape 12 is detached from the pads 6, 6 and top and bottom layers 8 and 9, the side layer 11 are removed from the outer peripheral area of the spring unit 1, and the second joining members 43 pulled at the outer peripheral side of the spring unit 1 are cut by a cutter, etc., for example.

By so doing, the pads 6, 6 and top and bottom layers 8 and 9 are released out of firm engagement with the flange cloths 42 and separated from the spring unit 1. It is, therefore, possible to separate the pads 6, 6 and outer cover body 7 from the spring unit 1 by a relatively simple operation.

Even in the fourth embodiment, as in the second embodiment shown in FIG. 4 or the third embodiment shown in FIG. 5 the second joining members 43 may be heat shrunk after the pads 6 are temporarily fixed to the upper and lower side areas of the spring unit 1 by the thermosetting bonding agent 31 and a string-like member 32-and-button 33 combination.

Figure 10:
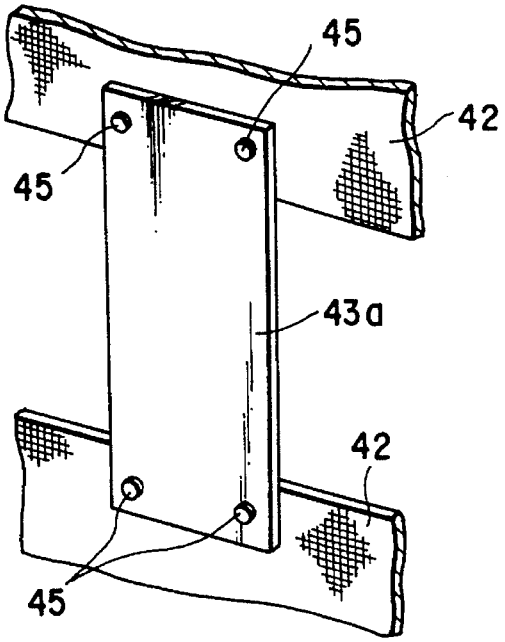
FIG. 10 is a perspective view showing a joining member joined to flange cloths in a fifth embodiment of the present invention.
Figure 11:
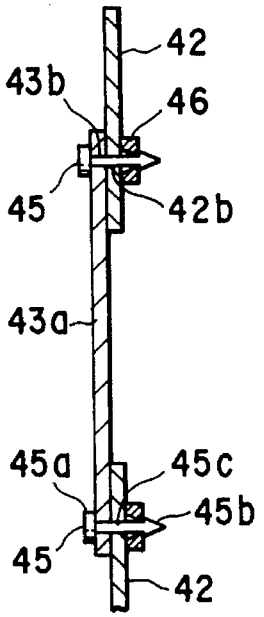
FIG. 11 is a cross-sectional view showing a joined state of the joining member and flange cloths in the fifth embodiment.

FIGS. 10 and 11 show a fifth embodiment of the present invention. This embodiment shows a variant of a joining means for joining a second joining member 43*a* to the flange cloth 42 and the joining means has pin members 45 made of synthetic resin. The pin member 45 has a head 45*a* at one end and a wedge-like section 45*b* at the other end. The presence of the wedge-like section 45*b* can prevent a corresponding tapering stop member 46 from being slipped out of the pin.

The second joining member 43*a* is comprised of a band-like heat-shrinkable synthetic resin sheet or a band-like synthetic resin fiber-braided cloth and cut to a predetermined length. The second joining member 43*a* has two pairs of first engaging holes 43b, 43b one at each end portion. At the other end sides of the upper and lower flange cloths, second engaging holes 42b are formed at an interval corresponding to that of the first engaging holes 43b, 43b.

The second joining member 43a can be joined to the flange cloth 42 by inserting the wedge-like section 45a of the pin 45 into those aligned first and second engaging holes 43b and 42b of the second joining member 43a and flange cloth 42, respectively, and fitting the stop member 46 relative to the wedge-like section 45a of the pin 45 extending out of the flange cloth 42.

According to the aforementioned structure, the second joining member 43a can be readily and rapidly joined to the flange cloth 42 without the necessity of using a loop-like member as in the fourth embodiment.

The flange cloths, though usually being provided at the inner surfaces of the whole marginal edge portions of the top and bottom layers, may be provided at intervals along the marginal edge portions of the top and bottom layers so that the flange cloths may be joined together by the second joining members 43, 43a at those corresponding areas.

As the joining means, use may be made of any proper means, such as clips and stitching, instead of the pins 45 and stop members 46.

Figure 12:
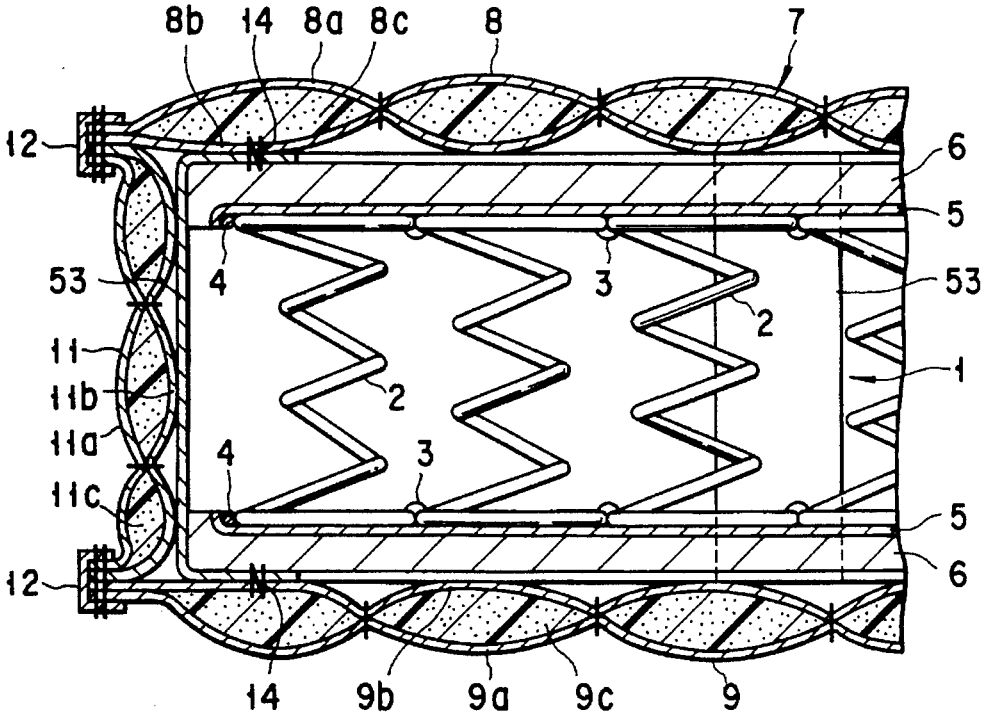
FIG. 12 is a cross-sectional view partly showing a mattress apparatus according to a sixth embodiment of the present invention.
Figure 13:
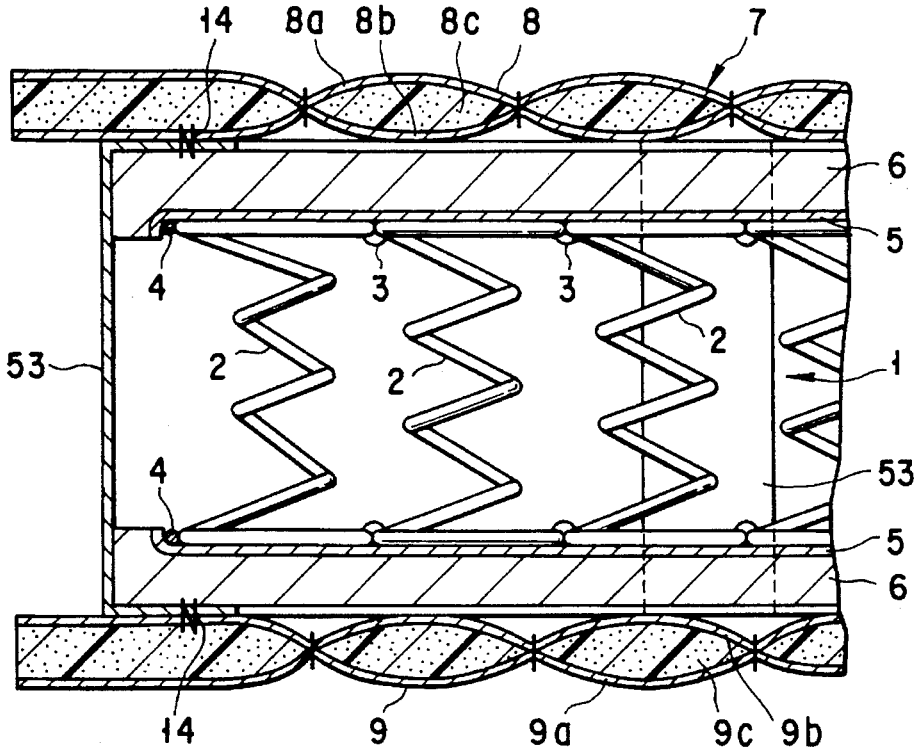
FIG. 13 is a cross-sectional view showing a state before the mounting of side layers of an outer cover body in the mattress apparatus.

FIGS. 12 and 13 show a sixth embodiment of the present invention. In this embodiment, third joining members 53 are formed of a heat-shrinkable synthetic resin sheet or synthetic resin fiber-braided cloth and have their one end side and other end side joined by a means, such as stitching and bonding agent, to the marginal edge portions of underlying cloths 8b and 9b of top and bottom layers 8 and 9 and, in this embodiment, are stitched by a string 14 to the marginal edge portions of these underlying cloths 8b and 9b. The third joining members 53 are partly provided at a predetermined interval around the marginal edge areas of the spring unit 1.

when the mattress apparatus is to be assembled with the use of the third joining members 53, the top and bottom layers 8 and 9 are arranged over the upper and lower sides of the spring unit 1 with pads 6, 6 provided one on the upper side and one on the lower side of the spring unit 1 and, by so doing, both the ends of the third joining members 53 may be joined to the underlying cloths 8b and 9b of the top and bottom layers 8 and 9 or the spring unit 1 may be inserted between the top and bottom layers 8 and 9 with the protection members 5 and pads 6 stacked over the spring unit 1.

If the top and bottom layers 8 and 9 are stacked such that they are joined by the third joining members 53 with the pads 6 placed one over the upper side and one over the lower side of the spring unit 1, a resultant structure, that is, a temporarily assembled mattress apparatus, is passed through the hot air heating furnace 22 where the third joining members 53 are heat shrunk. By so doing, the pads 6 and top and bottom layers 8 and 9 are fixedly held in place over the upper and lower sides of the spring unit 1.

Even in the sixth embodiment, the protection members 5, 5 and pads 6, 6 arranged over the upper and lower sides, respectively, of the spring unit 1 are temporarily fixed by a thermosetting bonding agent 31 to the upper and lower sides of the spring unit 1 as in the second embodiment shown in FIG. 4.

By so doing, it is possible to prevent the pads 6, 6 from being displaced at the upper and lower side areas of the spring unit 1 before the third joining member 53 is heat-shrunk.

Figure 14:
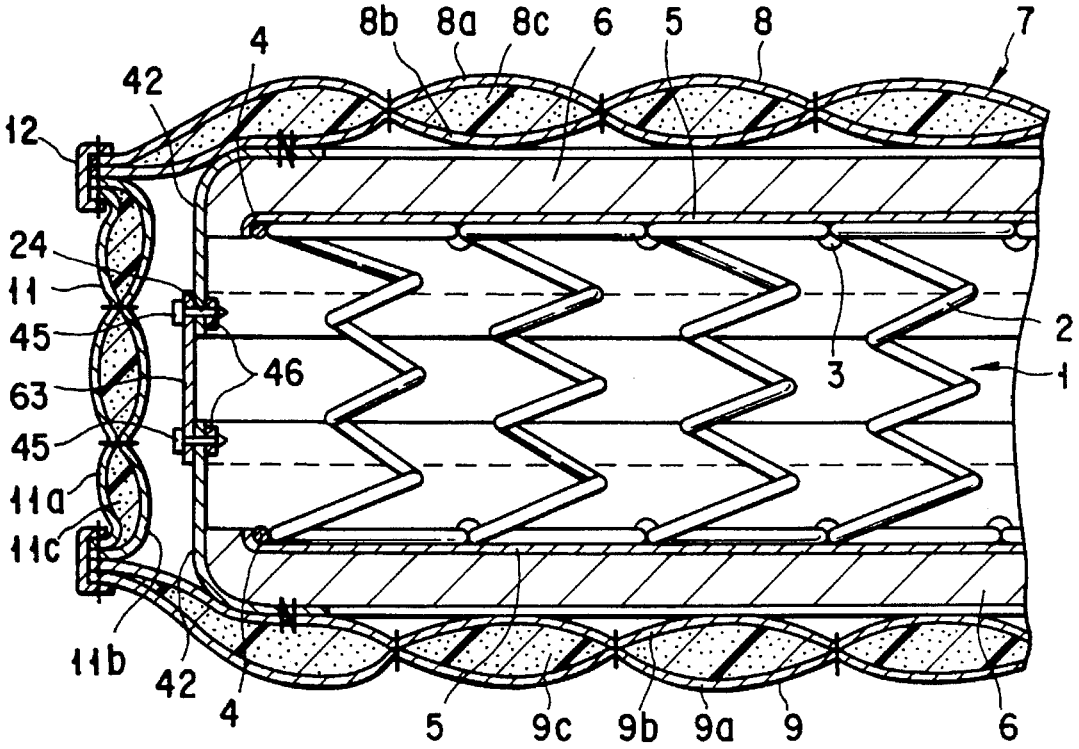
FIG. 14 is a cross-sectional view partly showing a mattress apparatus according to a seventh embodiment of the present invention.

FIG. 14 shows a seventh embodiment of the present invention. The seventh embodiment constitutes a variant of the second embodiment shown in FIGS. 6 and 7 and is of such a type that, with the one end sides of a pair of flange cloths 42, upper and lower, joined to the inner surfaces of the whole marginal edge portions of top and bottom layers 8 and 9, the other end sides of the upper and lower flange cloths 42, 42 are joined to each other by fourth joining member 63 over the whole marginal area of the flange cloths. The fourth joining member 63 is made of a heat-shrinkable synthetic resin sheet or synthetic resin fiber-braided cloth.

The fourth joining member 63 is formed of a band-like member and joined to the flange cloths 42, 42 at the upper and lower end portions (viewed in the width direction of the fourth joining member) by the joining structure shown in FIGS. 10 and 11.

If, in this way, the fourth joining member 63 are provided around the whole marginal edge area of the spring unit 1, then the fourth joining member 63, being heat shrunk, enable pads 6, 6 to be uniformly compressed around the whole marginal edge of the pads 6, 6. For this reason, the mattress apparatus is maintained under a good condition without being unevenly contoured at the upper marginal edge area and the pads 6, 6 and outer cover body 7 can be positively held in place.

Further, since the upper and lower flange cloths 42, 42 are joined together by the fourth joining members 63 before the fourth joining members 63 are heat shrunk and, by so doing, the pads 6, 6 are held in place at the upper and lower sides of the spring unit 1 without being displaced, the pads 6, 6 need not be temporarily fixed to the spring unit 1.

Figure 15:
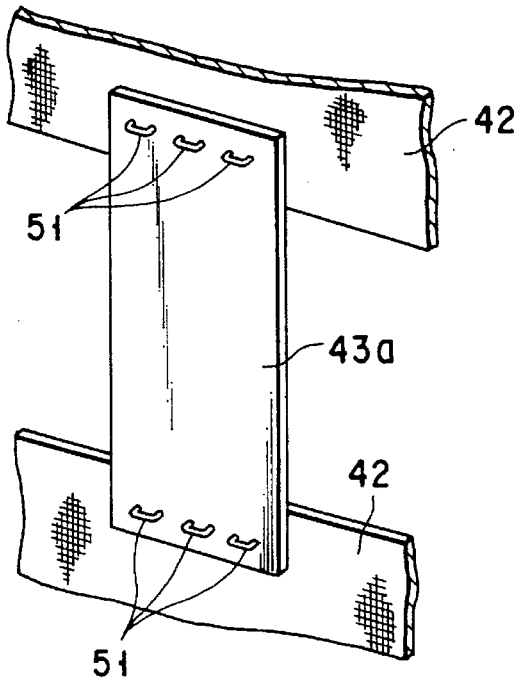
FIG. 15 is a perspective view showing a joining member and flange cloths in a mattress apparatus according to an eighth embodiment of the present invention.

FIG. 15 shows an eighth embodiment of the present invention. This embodiment constitutes a variant of the fifth embodiment as shown in FIGS. 10 and 11. In this variant, second joining members 43a are joined to upper and lower flange cloths by stitching strings, not by the pins.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A mattress apparatus comprising:

a spring unit having upper and lower sides;

a pad arranged at least on the upper side of the spring unit to provide a laminate structure with the spring unit;

an outer cover body having;

a top layer covering at least an upper surface of the laminate structure;

and a side layer covering an outer peripheral area of the laminate structure; and a joining member made of a heat-shrinkable synthetic resin sheet material, the joining member having one end width portion which is joined to an inner surface of the top layer of the outer cover body and, upon being heat shrunk, the joining member immovably holding the pad and outer cover body relative to the spring unit under its shrinking force.

2. A mattress apparatus according to claim 1, wherein the pad arranged on the spring unit is temporarily fixed to the spring unit by a temporary fixing means.

3. A mattress apparatus according to claim 1, wherein the pad arranged on the spring unit is temporarily fixed to the spring unit by a bonding agent.

4. A mattress apparatus according to claim 1, wherein the pad arranged on the spring unit is temporarily fixed to the spring unit by a temporary fixing apparatus which comprises;

a string member extending in a thickness direction of the laminate structure of the spring unit and pad; and buttons attached to extending ends of the string member.

5. A mattress apparatus according to claim 1, wherein said joining member is made of a heat-shrinkable synthetic resin tape.

6. A mattress apparatus according to claim 1, wherein a plurality of said joining members are provided around a whole outer periphery of the spring unit.

7. A mattress apparatus according to claim 1, wherein a plurality of said joining members are provided partly around the periphery of the spring unit.

8. A mattress apparatus comprising:

a spring unit having upper and lower sides;

a pad arranged at least on the upper side of the spring unit to provide a laminate structure with the spring unit;

an outer cover body having:

a top layer covering at least an upper surface of the laminate structure;

and a side layer covering an outer peripheral area of the laminate structure; and a joining member made of a heat-shrinkable synthetic resin fiber-braided cloth, the joining member having one end width portion which is joined to an inner surface of the top layer of the outer cover body and, upon being heat shrunk, the joining member immovably holding the pad and outer cover body relative to the spring unit under its shrinking force.

9. A mattress apparatus according to claim 8, wherein the pad arranged on the spring unit is temporarily fixed to the spring unit by a temporary fixing means.

10. A mattress apparatus according to claim 8, wherein the pad arranged on the spring unit is temporarily fixed to the spring unit by a bonding agent.

11. A mattress apparatus according to claim 8, wherein the pad arranged on the spring unit is temporarily fixed to the spring unit by a temporary fixing apparatus which comprises;

a string member extending in a thickness direction of the laminate structure of the spring unit and pad; and buttons attached to extending ends of the string member.

12. A mattress apparatus according to claim 8, wherein a plurality of said joining members are provided around a whole outer periphery of the spring unit.

13. A mattress apparatus according to claim 8, wherein a plurality of said joining members are provided partly around the periphery of the spring unit.

* * * * *